US006701545B1

(12) United States Patent
Ferneau et al.

(10) Patent No.: US 6,701,545 B1
(45) Date of Patent: Mar. 9, 2004

(54) MULTIPLE LEVEL ROLL-IN COT

(75) Inventors: Richard Henry Ferneau, Washington Court House, OH (US); Bret William Smith, Kings Mills, OH (US); William Harry Benedict, Jamestown, OH (US); Eugene VanDyne, Wilmington, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 10/227,765

(22) Filed: Aug. 26, 2002

(51) Int. Cl.[7] ..... A61G 1/048; A61G 1/02

(52) U.S. Cl. ..... 5/86.1; 5/110; 5/83.1; 296/20

(58) Field of Search ..... 5/429, 428, 430, 5/86.1, 83.1, 110, 111, 611; 296/20

(56) References Cited

U.S. PATENT DOCUMENTS

| | | | | |
|---|---|---|---|---|
| 2,958,873 A | | 11/1960 | Ferneau | |
| 3,304,116 A | * | 2/1967 | Stryker | 296/20 |
| 3,341,246 A | * | 9/1967 | Lavallee | 296/20 |
| 3,644,944 A | | 2/1972 | Bourgraf et al. | |
| 3,980,334 A | | 9/1976 | Ferneau et al. | |
| 4,037,871 A | | 7/1977 | Bourgraf et al. | |
| 4,052,097 A | | 10/1977 | Weil et al. | |
| 4,097,941 A | | 7/1978 | Merkel | |
| 4,192,541 A | | 3/1980 | Ferneau | |
| 4,695,072 A | | 9/1987 | Brooks | |
| 4,767,148 A | | 8/1988 | Ferneau et al. | |
| 5,069,465 A | * | 12/1991 | Stryker et al. | 296/20 |
| 5,432,966 A | | 7/1995 | Berta et al. | |
| 5,435,027 A | | 7/1995 | Bourgraf et al. | |
| 5,509,159 A | | 4/1996 | Du-Bois | |
| 5,537,700 A | | 7/1996 | Way et al. | |
| 5,575,026 A | | 11/1996 | Way et al. | |
| 5,987,673 A | | 11/1999 | Smith | |
| 6,125,485 A | | 10/2000 | Way et al. | |
| 6,381,781 B1 | * | 5/2002 | Bourgraf et al. | 296/20 |
| 6,389,623 B1 | | 5/2002 | Flynn et al. | |

FOREIGN PATENT DOCUMENTS

| | | |
|---|---|---|
| DE | 743 689 C | 12/1943 |
| GB | 2 281 201 A | 3/1995 |

* cited by examiner

*Primary Examiner*—Frederick L. Lagman
(74) *Attorney, Agent, or Firm*—Dinsmore & Shohl LLP

(57) ABSTRACT

A multiple level elevating cot adapted to be rolled into emergency vehicles, the cot having a wheeled undercarriage supporting a cot frame having a leading end and a trailing end, and adapted to selectively secure the cot frame in a plurality of elevational positions. The cot frame includes a pair of side extension arms provided between the leading end and the trailing end, each of the side extension arms being adapted to slidably extend outwardly from a stowed position adjacent the cot frame to an extended position substantially perpendicular to the cot frame. The cot frame may form a part of an integral stretcher or may serve as a carrier to which a separable top structure, such as a stretcher/stair chair, may be detachably secured, the cot frame including seats for slidably receiving the top structure and latching means for securing the top structure to the cot frame.

21 Claims, 8 Drawing Sheets

MULTIPLE LEVEL ROLL-IN COT

BACKGROUND OF THE INVENTION

This invention relates to ambulance cots and more particularly with improvements to multi-level roll-in cots capable of being used in different types of emergency vehicles having cot-receiving floors.

Ambulance cots typically comprise an essentially rectangular patient support frame with wheeled collapsible-leg assemblies enabling the stretcher to be stowed or loaded into the back of an ambulance. Examples of such prior art cots are disclosed in U.S. Pat. Nos. 4,097,941, 4,192,541, 4,767,148, 5,537,700, and 5,575,026. Although the prior art cots have been generally adequate for their intended purposes, they have not been satisfactory in all aspects. Such ambulance cots are not always suited to accommodate the medical needs of persons with large bodies. Often it is difficult to place a large-bodied patient in such conventional cots, and sometimes these cots cannot accommodate such large-bodied persons at all. In those situations, a portable stretcher is typically placed on top of such an ambulance cot in an unsecured or jerry-rigged fashion. However, for obvious reasons the lack of a means to safely and securely transport such large-bodied patient on these conventional cots can degrade the quality of medical care provided to them.

Once such a large-body patient is loaded into the cot, the disproportionate size of the patient and the compact nature of both conventional stretchers and ambulance cots often provide little extra space for emergency equipment, such as oxygen tanks, intravenous medications, cardio monitors and the like which are required for immediate treatment. These devices are often placed on the empty spaces of the cot's mattress without compromising the patient carried thereon. However, with such a large-bodied patient, the lack of available mattress space can lead to distractions to the emergency attendants, clutter in the transport vehicle, and general difficulty during transportation of the patient.

Further, the compact nature of such conventional ambulance cot provides little extra side rail surfaces by which extra attendants can grip and lift such cots into the transport deck of an emergency vehicle when carrying such a large-body patient. This lack of convenient handling/gripping surfaces therefore requires the attendants to either compromise the normal handling/gripping surfaces or find an available side-rail surface in order to increase the number of attendants lifting the cot. As a result, the attendants are often unevenly distributed or bunched up around the cot placing strain and unnecessary stress on the attendants because of the often, uneven handling/lifting of the cot. Strains and stresses are also placed on the patient as well as the stretcher undercarriage by this uneven handling/lifting of the cot during loading. Accordingly, there remains a need in the art for an ambulance cot arrangement which alleviates or at least ameliorates such difficulties.

SUMMARY OF THE INVENTION

The present invention alleviates or at least ameliorates the above-mentioned difficulties by providing a simple arrangement that conveniently provides additional side handling/lifting surfaces to a cot construction. Cot constructions of the present invention include a cot frame supported by a stable undercarriage, which permit the cot frame to be raised and lowered to a plurality of positions of use. The cot frame may be provided with integral patient support features, such as positionable back, leg, and side arm supports, or may be provided with a removable patient support structure which is detachably secured to the cot frame. Where a removable patient support structure or top is provided, the cot frame is provided with locking mechanism, which automatically locks the removable top to the cot frame when the top is seated on the frame, readily, accessible release means being provided to permit rapid detachment of the top from the cot frame.

In order to expand the handling/lifting ability of attendants around the cot frame, at least one transverse cot frame member slidable houses a pair of side-arm extensions according to the present invention. Such an arrangement provides the cot constructions of the present invention with extra side handling/lift surfaces without compromising the existing handling/lifting surfaces. Accordingly, the cot constructions may be loading directly into an emergency vehicle in a controlled and more-evenly spaced fashion when carrying a large-bodied patient thereon, thereby reducing the stress adds strain on the attendants, the patient, and the cot frame.

In one embodiment of the present invention, an elevating cot adapted to be rolled into emergency vehicles is disclosed. The cot comprises a generally rectangular cot frame having a leading end and a trailing end, and a pair of side extension arms provided to the cot frame between the leading end and the trailing end. Each of the side extension arms is adapted to slidably extend outwardly from a stowed position adjacent the cot frame to an extended position substantially perpendicular to the cot frame.

In another embodiment of the present invention, an elevating cot adapted to be rolled into emergency vehicles is disclosed. The cot comprises a generally rectangular undercarriage having wheels, a generally rectangular cot frame having a leading end and a trailing end, leg members interconnecting the cot frame and the undercarriage, and a latching device adapted to selectively secure the leg members in a plurality of elevational positions. A pair of side extension arms is provided to the cot frame between the leading end and the trailing end. Each of the side extension arms is adapted to slidably extend outwardly from a stowed position adjacent the cot frame to an extended position substantially perpendicular to the cot frame.

In still another embodiment of the present invention, an elevating cot adapted to be rolled into emergency vehicles is disclosed. The cot comprises a generally rectangular undercarriage having a leading end and a trailing end, wheels affixed to the undercarriage, and a generally rectangular cot frame overlying the undercarriage. The cot frame has a leading end and a trailing end. Co-acting pairs of complementary cross-forming frame members extend between and interconnect the cot frame and the undercarriage. Each of the pairs of frame members comprises a first frame member of fixed length and a second frame member having an extensible section at its lowermost end. A latching device is adapted to selectively secure the cross-forming members in a plurality of elevational positions. A pair of side extension arms is provided to the cot frame between the leading end and the trailing end, each of the side extension arms is adapted to slidably extend outwardly from a stowed position adjacent the cot frame to an extended position substantially perpendicular to the cot frame.

These and other features and advantages of the invention will be more fully understood from the following description of some embodiments of the invention taken together with the accompanying drawings. It is noted that the scope of the claims is defined by the recitations therein, and not by the specific discussion of features and advantages set forth in the present description.

BRIEF DESCRIPTION OF THE DRAWINGS

The present invention is illustrated by way of example and not limitation in the accompanying figures, in which like references indicate similar elements, and in which.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiment(s) of the present invention.

DESCRIPTION OF THE PREFERRED EMBODIMENTS

Figure 1A:
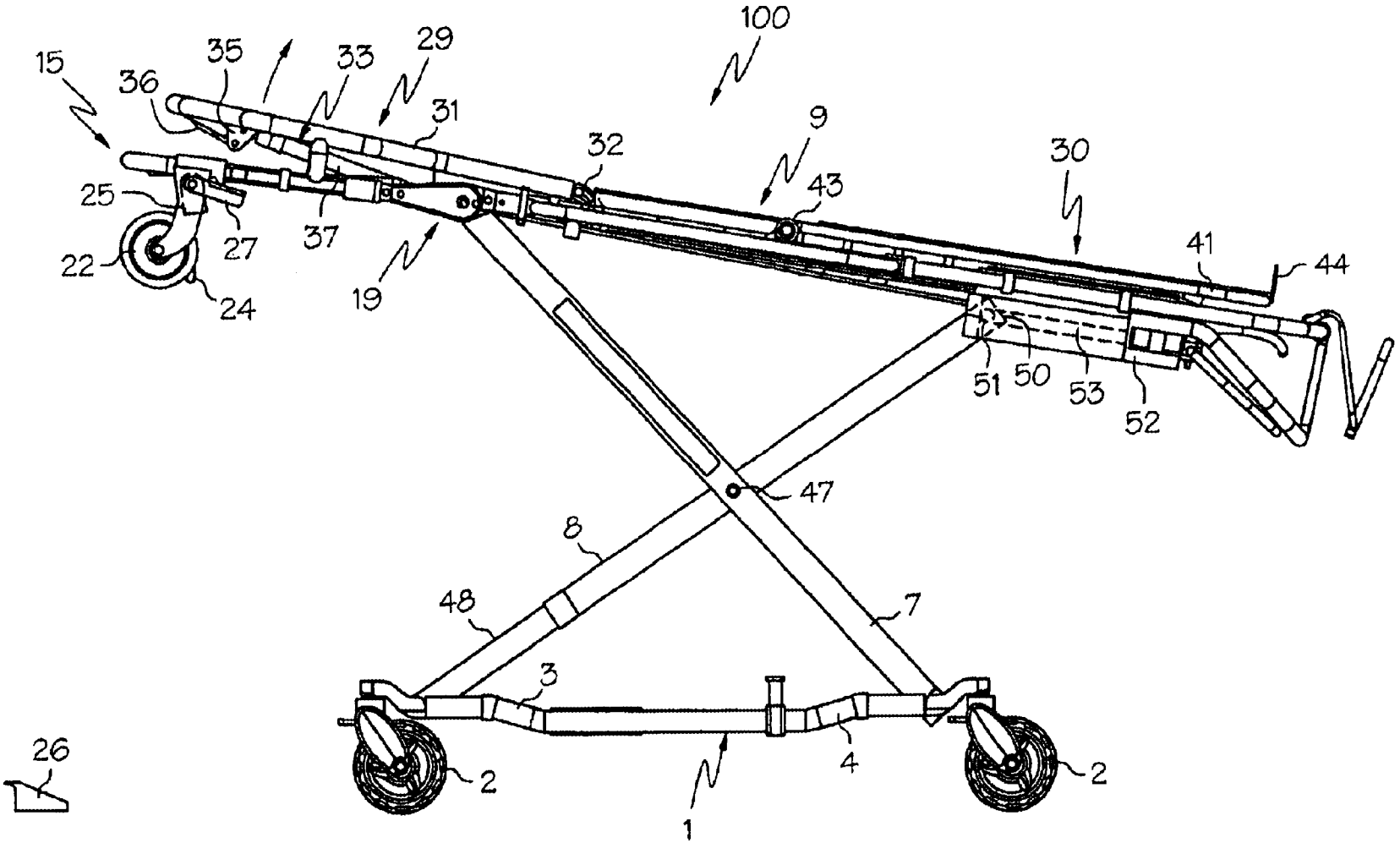
FIGS. 1*a* and 1*b* are side views of a cot structure embodiment of the invention having an integral top, with parts in dotted lines for purposes of illustration.

Referring first to FIGS. 1*a,* 1*b,* 2*a,* and 2*b,* illustrated is a cot structure embodiment of the invention having an integral top structure, with parts broken away and others in dotted lines for purposes of illustration. The cot is indicated generally at 100, and has a rectangular undercarriage 1 mounting pairs of caster wheels 2 at its opposite ends. The undercarriage 1 includes opposing side frame members 3 and 4, which are interconnected by transverse frame members 5 and 6, the latter being best seen in FIG. 2.

Figure 2A:
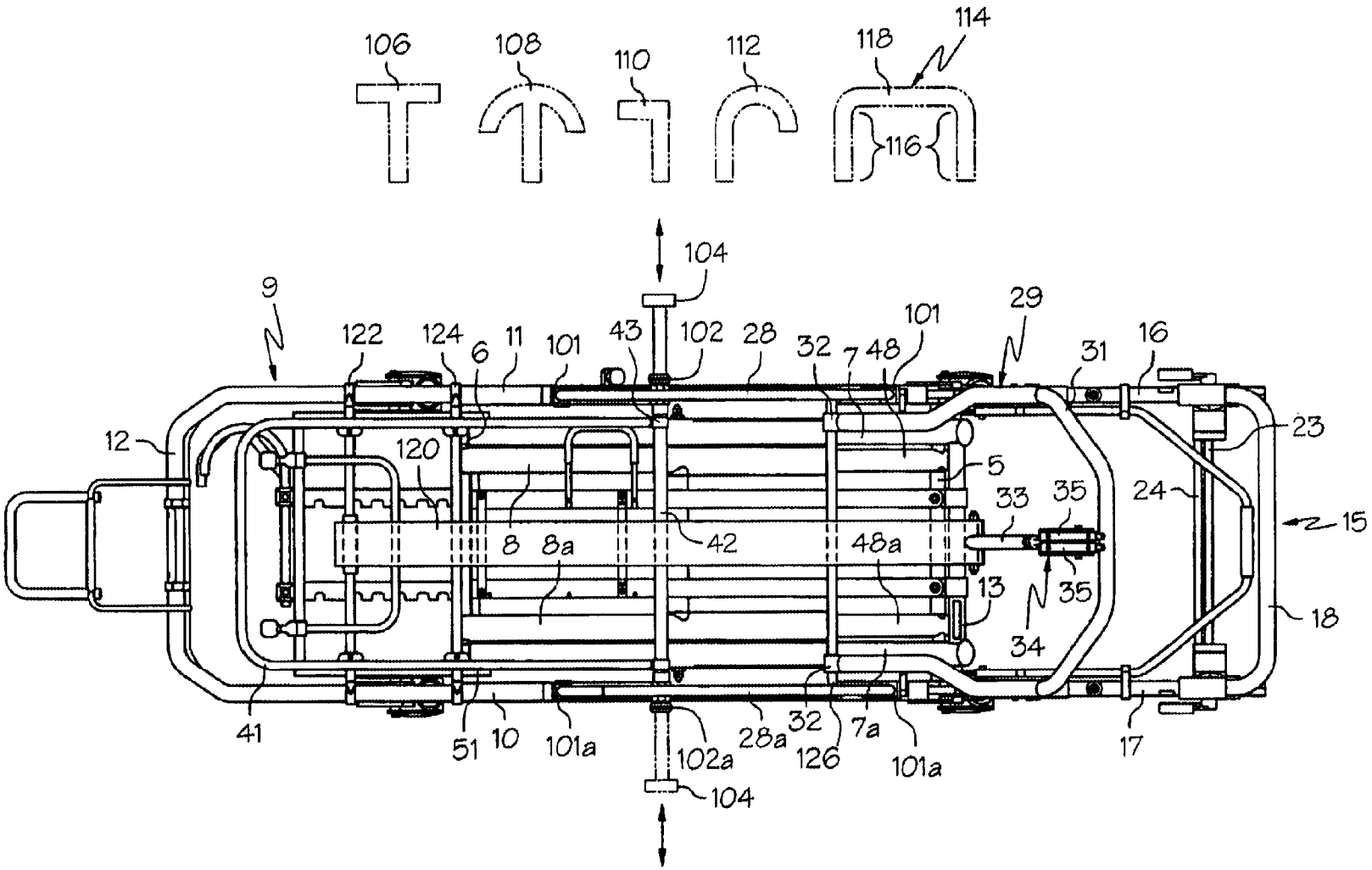
FIG. 2*a* is a top plan view of the embodiment of FIG. 1, with parts broken away to show underlying parts.
Figure 2B:
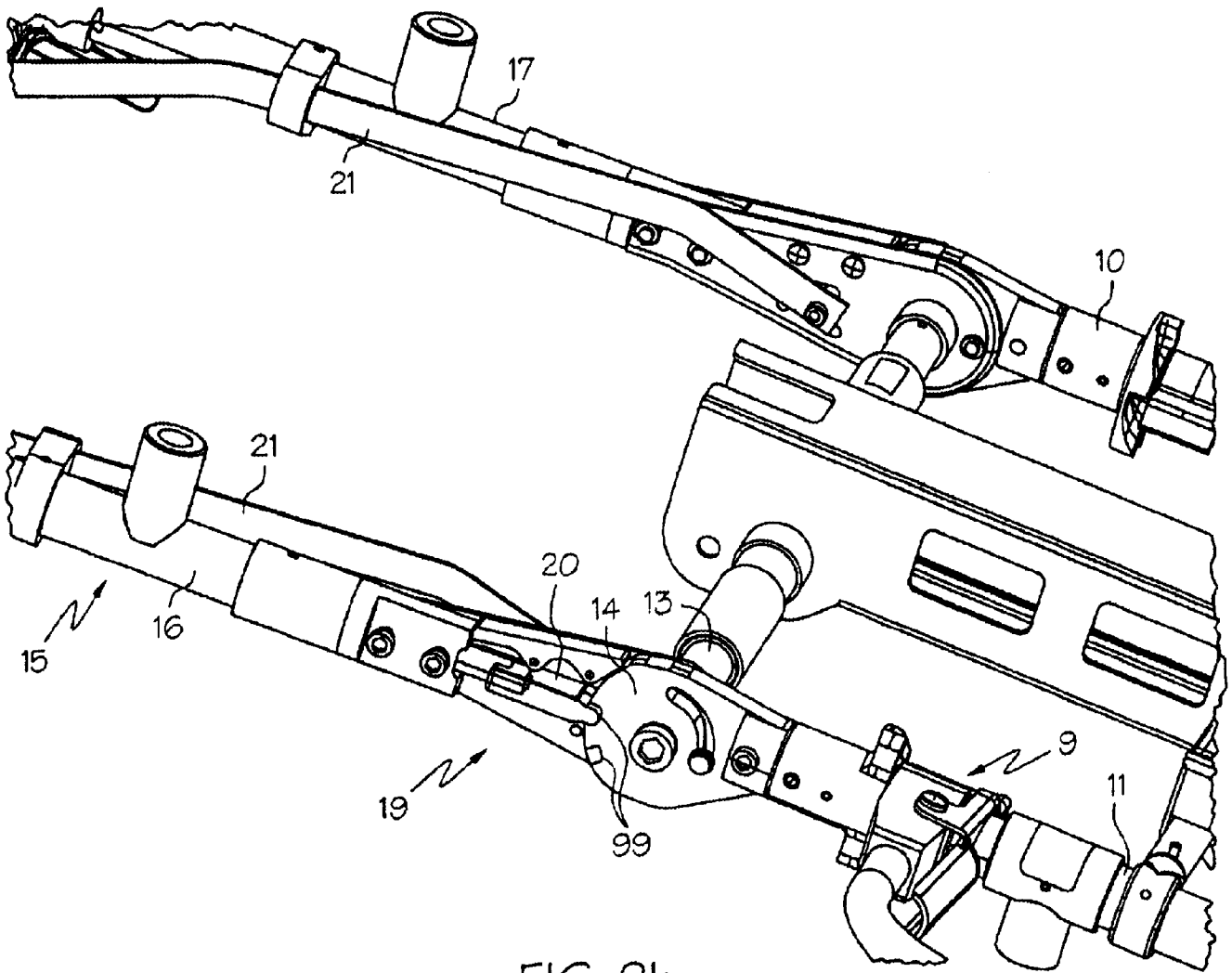
FIG. 2*b* is an enlarged fragmented perspective view of a portion of the embodiment of FIG. 2*a,* with parts removed to show underlying parts.

Extending upwardly from the undercarriage 1 are pairs of cross forming frame members 7, 8 and 7*a,* 8*a,* which serve to interconnect the undercarriage 1 with a cot frame 9. Cot frame 9 includes opposing tubular side frame members 10 and 11 interconnected at the foot or trailing end by a transverse tubular end member 12. At their leading or forward ends, the side rails 10 and 11 each terminate at a respective hinge pivot 14. As best seen by FIG. 2*b,* supported between the pair of hinge pivots 14 is a transverse frame 13 having a drop frame 15 rotatably coupled thereto. Drop frame 15 includes tubular side frame portions 16 and 17 joined at their forward ends by an end frame member 18 (FIG. 2*a*).

Figure 1B:
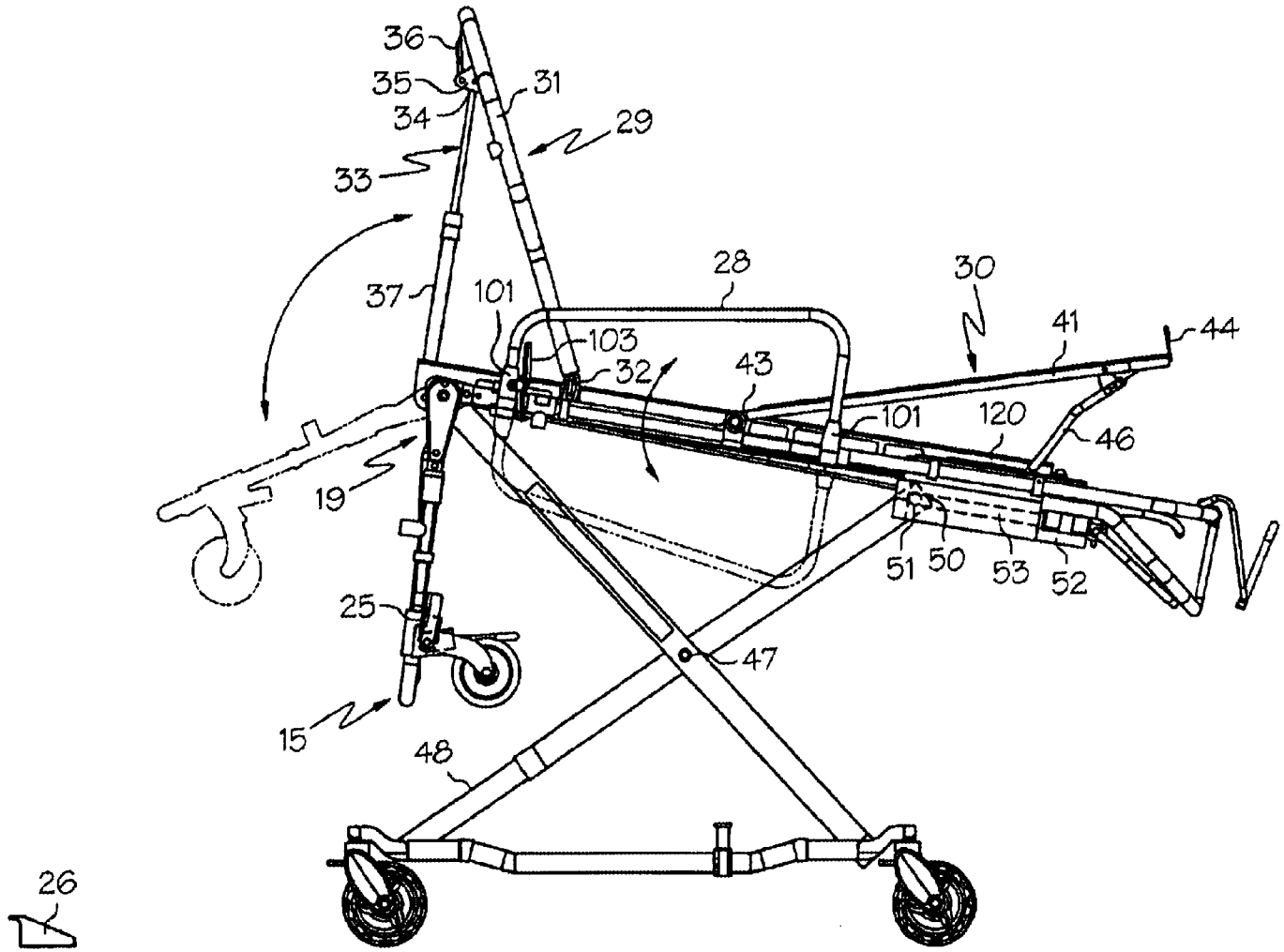

The drop frame 15 is releasable engaged by the pair of hinge pivots 14, which also limits the range of motion of drop frame 15. In particular, rotation of drop frame 15 is arrested by latch mechanism 19, which is best seen in FIG. 2*b*. Latch mechanism 19 permits the drop frame 15 to be moved from the extended position, as seen in FIGS. 1 and 2, to a middle position, which is shown in dotted lines in FIG. 1*b,* or to a collapsed position also shown in FIG. 1*b*.

The drop frame 15 is locked either in the extended position or middle position by a spring biased latch 20 engaging a respective one of slots 99 provided in each pivot hinge 14. A release handle 21 provided to the drop frame 15 releases the sliding latch 20 from the engaged slot 99, such that the drop frame 15 may be repositioned. It is to be appreciated that positioning the drop frame 15 in the middle position provides a lower lifting handle position for improved ergonomics.

The drop frame 15 is provided with a pair of loading wheels 22 projecting downwardly from the outermost ends of side frame sections 16 and 17. The wheels 22 are interconnected by a rod 23 mounting a generally U-shaped tubular bail 24, which is spring biased to the downwardly extending position seen in FIGS. 1*a* and 1*b*. The tubular bail 24 is biased by springs 25, and is adapted to engage a tongue-like floor fitting 26 mounted on the floor of the emergency vehicle. The bail 24 also may be deflected upwardly by a release arm 27 positioned adjacent both sides of the cot frame, which permits the attendant to release the bail 24 from engagement with the floor fitting 26 when it is desired to remove the cot from the vehicle.

It will be understood that the basic cot frame 9 may be provided with various adjustable features, such as folding side arms 28, a multiple-position backrest, indicated generally at 29, and an adjustable leg section for placing the patient in a shock position, indicated generally at 30, all of which are conventional features. As best seen by FIG. 2*a,* the backrest 29 has a generally u-shaped frame member 31 hingedly connected at its ends to a traverse frame member 126 (FIG. 2*a*), respectively, by means of pivot fittings 32. The backrest 29 is movable from a reclined position shown in FIG. 1*a,* to an upright position illustrated in FIG. 1*b*.

The backrest 29 is assisted from the reclined position to the upright position, and a plurality of positions therebetween indicated by the arrow line in FIGS. 1*a* and 1*b,* by a lifting device 33. The lifting device 33 is pivotally attached at an upper end 34 to a set of mounts 35. Mounts 35 are attached to the patient surface and the backrest frame 31 end position. Preferably, the lifting device 33 is a gas-assisted cylinder or alternatively, either a hydraulically or a mechanically assisted cylinder. In the illustrated embodiment of FIG. 1*b,* manipulation of a lever 36, also provided at the upper end of the lifting device 33, causes gas-assisted cylinder 37 to raise or lower the backrest 29 as desired. That is, depressing or raising the lever 36 operates a detent on the gas-assisted cylinder 37, which releases a locking mechanism internally on the cylinder and permits movement of the backrest 29. When the lever 36 is released, it moves back to a centered, at rest, position permitting a detent (not shown) on the cylinder to rise, locking the backrest 29 in place. The lower end of the lifting device 33 is connected to the cot frame 9 by a rotatable mount (not shown) so that it may rotate downward as it retracts permitting the backrest 29 to be placed in the reclined position.

The adjustable leg section 30 is formed by u-shaped frame members 41 (partially shown in FIG. 2) hingedly connected at its ends to a transverse hollow tubular member 42 by hinge members 43, as seen in FIG. 2. At the opposed end of the frame member 41, a footrest 44 is mounted. The footrest 44 is adapted to be raised and lowered by latch members 46 of known construction. Other features also may be provided, such as an auxiliary bail-like end frame member 40 underlying end frame member 12, which is positioned to be easily grasped by an attendant.

Referring to FIGS. 1*a* and 1*b*, the pairs of cross-forming frame members 7, 8 and 7*a*, 8*a* are pivotally connected by a pivot rod 47 at the point of intersection of the pairs of cross-formning frame members 7, 8 and 7*a*, 8*a*. In addition, the cross-forming frame members 8 and 8*a* telescopically receive tubular extensions 48 and 48*a* at their lowermost ends, which are pivotally connected to the transverse frame member 5 by fittings 49 and 49*a*, respectively. At their uppermost ends the cross-forming frame members 8 and 8*a* mount fittings 50 having guide pins 51 slidably received in elongated guide members 52 each provided with an elongated pin receiving slot 53.

Figure 4:
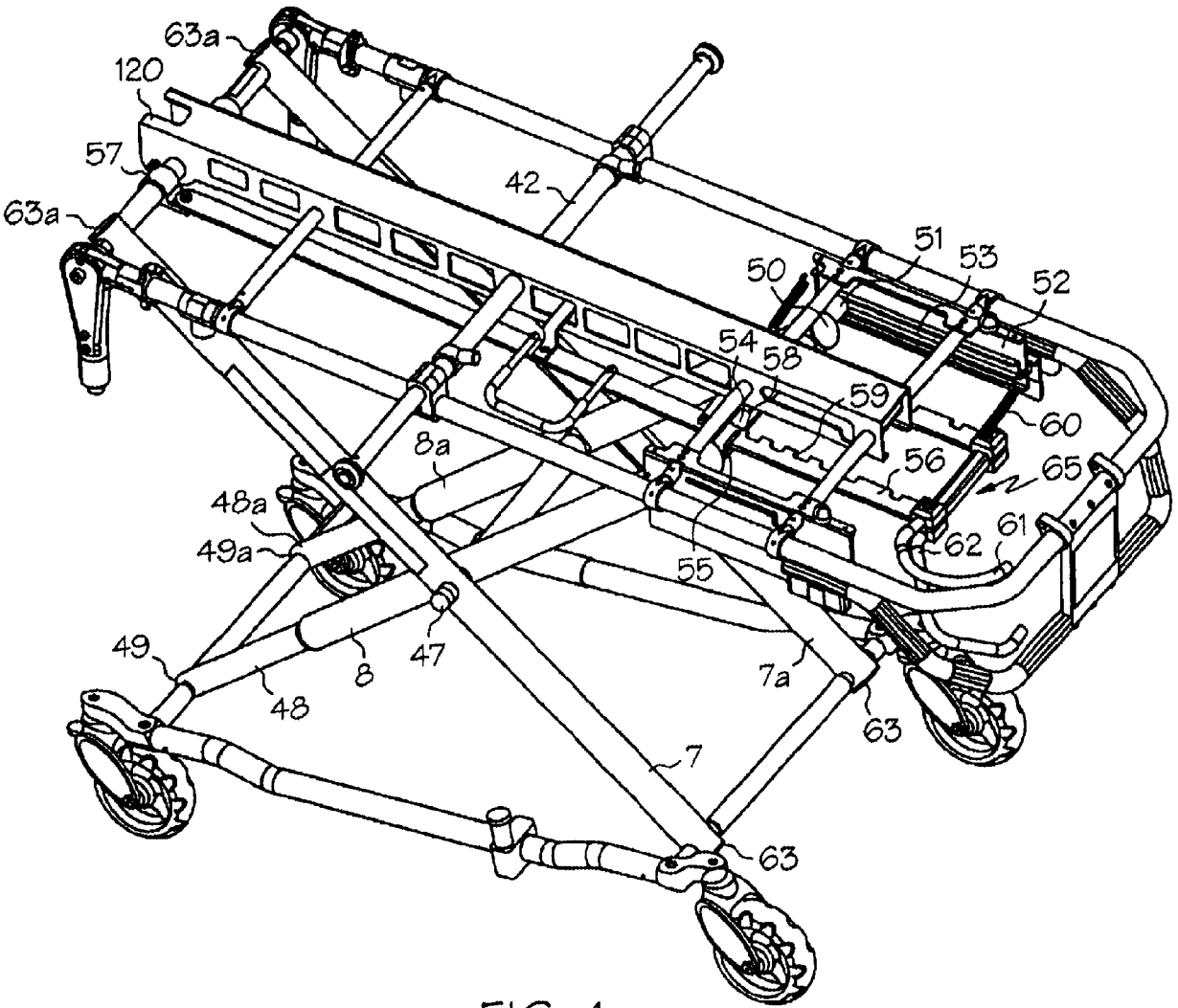
FIG. 4 is an elevational perspective view of another cot structure embodiment of the invention, with parts removed for purposes of illustration.

As best shown by FIG. 4, which has the same undercarriage arrangement of the embodiment of FIGS. 1*a* and 1*b*, pins 51 are interconnected to a latching device 65 adapted to selectively secure the cross-forming frame members 8 and 8*a* in a number of elevational positions. The latching device 65 is formed of a stabilizer 54 and locking bar 56. The stabilizer 54 includes a hollow passageway 55 that loosely receives the elongated locking bar 56. The locking bar 56 is connected at one end to a yoke 57 pivotally mounted on the transverse frame member 13. The locking bar 56 twists through substantially 90° intermediate its ends to provide a vertically disposed portion in engagement with the yoke 57 and a horizontally disposed portion extending through the passageway 55 in stabilizer 54. The passageway 55 has a latch pin 58 extending vertically therethrough for selective engagement with a series of notches or teeth 59 formed in the locking bar 56. A spring 60 is positioned to urge the notches in the locking bar into engagement with the pin. The locking bar 56 may be displaced laterally by means of loop-like release members 61 and 62, which are positioned to be grasped by the cot attendant either at the forward end of the cot or along one side thereof.

The lowermost ends of the cross-forming frame members 7 and 7*a* are pivotally connected to transverse frame member 6 of the undercarriage 1 by fittings 63. At their uppermost ends, the cross-forming frame members 7 and 7*a* are pivotally connected to the transverse frame member 13 of the cot frame by fittings 63*a*. The cross-forming frame members 7 and 7*a* may be reinforced intermediate their ends by sleeves 64, as seen in FIG. 3, an embodiment having substantially the same undercarriage arrangement of FIGS. 1*a* and 1*b*.

With latching device 65, the cot frame 9 of the various embodiments of the invention may be selectively secured in a plurality of elevational positions or collapsed against the undercarriage 1. This is accomplished by releasing the locking bar 56 and permitting the cross-forming frame members 8 and 8*a* to move to the outermost ends of the slots 53 in the elongated brackets 52. At the same time, extensible sections 48 and 48*a* telescope within the lowermost ends of cross-forming members 8 and 8*a*. As the cot 100 is elevated, the sets of cross-forming frame members 7 and 7*a* will elevate the cot frame relative to the undercarriage 1 in a generally horizontal plane. However, as the fully elevated positions of the cot frame are approached, e.g., such as the two innermost notches on the locking bar 56, the cot frame 9 will be inclined upwardly at its leading end, as illustrated in FIGS. 1*a*, 1*b*, 3, and 4. This upward inclination occurs due to the extensible cross-forming frame members 48 and 48*a*, and the relation of the pivot rod 47 to the points of intersection of the pairs of frame members 7, 8 and 7*a*, 8*a*. This upwardly inclined position elevates the loading wheels 22 to a higher position than if the cot frame remained horizontal and permitting the transfer of the cot into an emergency vehicle having an unusually high floor level.

Figure 3:
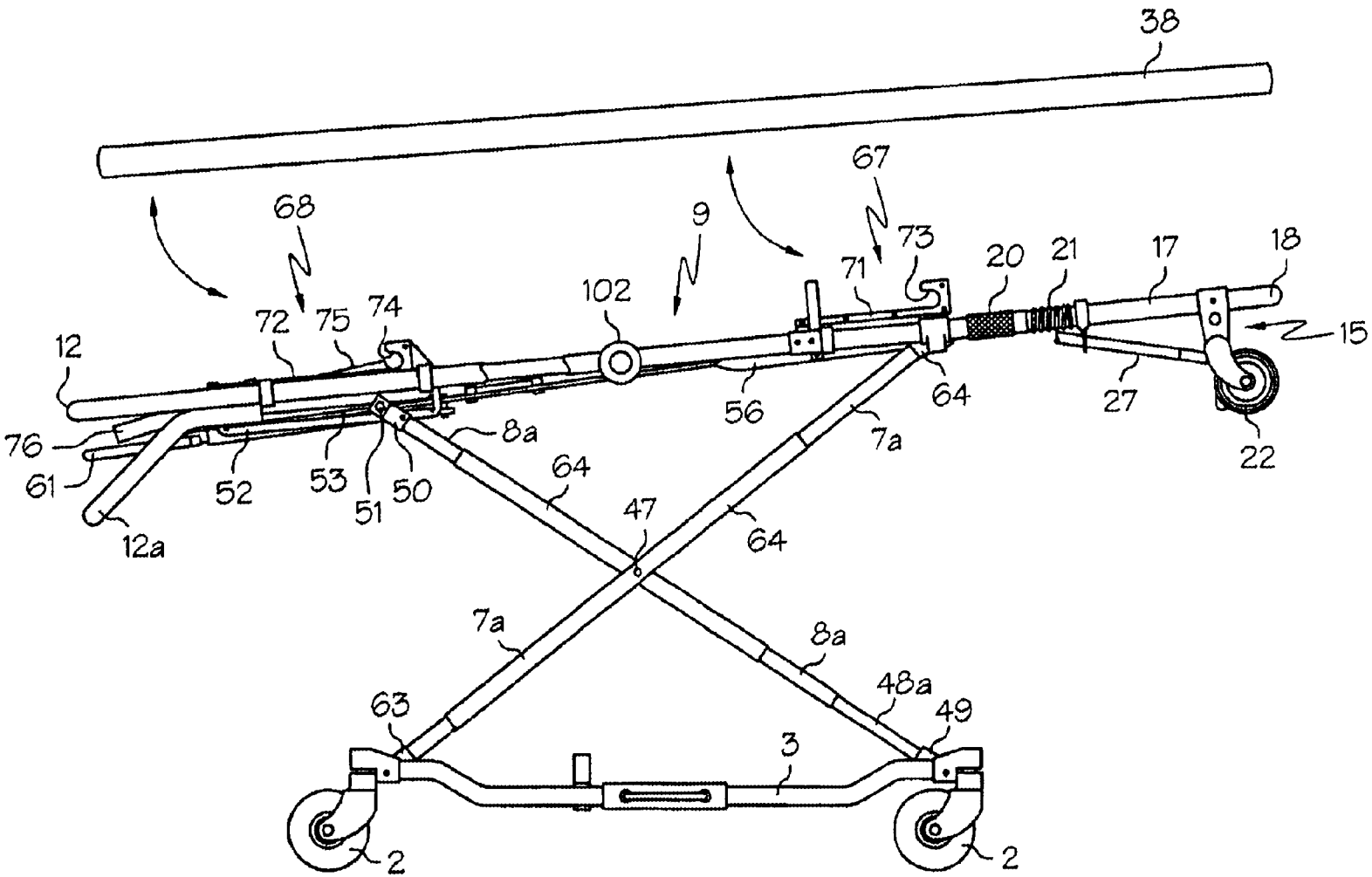
FIG. 3 is a side view of another cot structure embodiment of the invention adapted to receive a removable stretcher top.

Referring now to FIG. 3, illustrated is another cot structure embodiment of the invention having no top patient supporting structure, with parts broken away and others in dotted lines for purposes of illustration. Since many of the features of the embodiment of FIG. 3 are similar to those discussed in reference to FIGS. 1*la*, 1*b*, 2*a*, and 2*b*, only the differences will be discuss for brevity, in which like symbols indicate similar elements. In the illustrated embodiment of FIG. 3, the cot frame 9 is adapted to receive a removable top 38, such as a stretcher/chair stair illustrated in commonly assigned U.S. Pat. No. 4,767,148, which is herein fully incorporated by reference.

As shown in FIG. 3, the cot frame 9 is provided with leading and trailing sets of seats, indicated generally by 67 and 68, respectively. Seats 67 and 68 are adapted to receive correspondingly positioned frame members (not shown) of the removable top 38. It will be understood that the removable top 38, irrespective of whether it is a simple stretcher, a stretcher/stair chair or other form of cot, will be provided with opposing longitudinal frame members arranged to be seated on and secured to the sets of seats 67 and 68 of the cot frame. Seats 67 and 68 comprise horizontally disposed pairs of supporting plates (not shown), having a pair of vertically disposed brackets 71 and 72. Brackets 71 each have a C-shaped slot 73 therein. Brackets 72 also each have a C-shaped slot 74, but in this instance they are preceded by inclined cam rails 75 which serves to lock transversely extending frame members of the removable top 38 in the slots 74 until they are lifted from the slots, permitting the removable top 38 to be separated from the cot frame 9.

In the embodiment of FIG. 1, the backrest 29, as well as the remaining upper surface of frame 9 in this embodiment is covered with a support surface covering for accommodating a support mattress and/or a patient, which is illustrated by 201 in FIG. 2. For the embodiment of FIG. 3, the support surface covering may be optional as cot frame 9 is adapted to removably attach the conventional removable stretcher.

Figure 5:
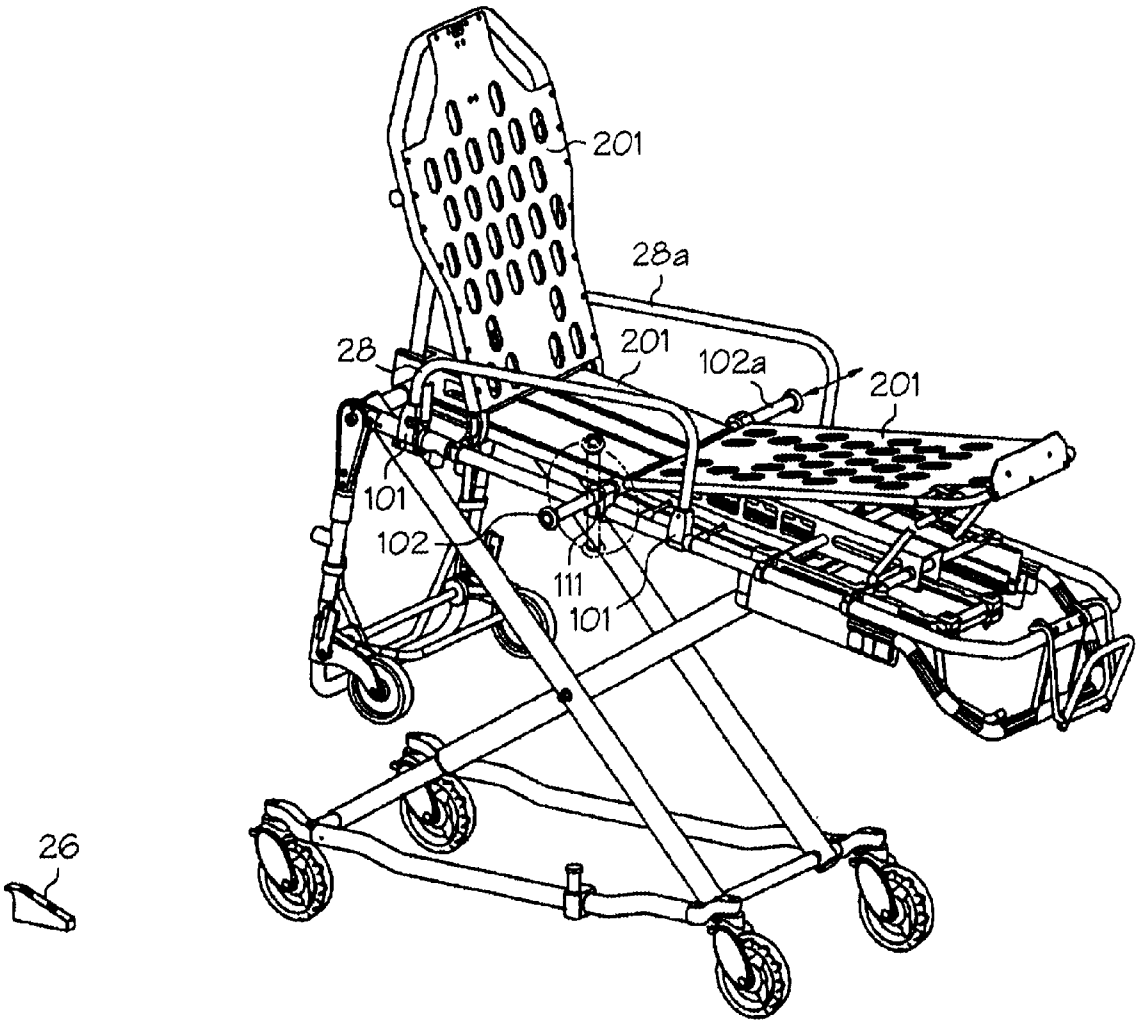
FIG. 5 is an elevational perspective view of another cot structure embodiment of the invention having a stretcher top.

Turning now to other features of the present invention, as best illustrated by FIGS. 2*a*, 4, 5, and providable to any of the foregoing cot constructions, a pair of side extension arms 102 and 102*a* is shown. Side extension arms 102 and 102*a* are slidable housed within an interior cavity of the transverse tubular member 42 (FIG. 4). Each of the arms 102 and 102*a* may be extended from a stowed position as illustrated by side extension arm 102*a*, outwardly from the cot frame 9 to an extended position, as illustrated in FIG. 2*a* by side extension arm 102. The side extension arms 102 and 102*a* when extended are substantial perpendicular to its respective side frame member 10 and 11 between the foot and trailing ends of the cot frame 9. In the extended and stowed positions, the side extension arms 102 and 102*a* are maintained so positioned by releasable securing methods, such as detents, spring biasing, locking pins, chocking collars, and the like.

Additionally, in another embodiment, each of side extension arms 102 and 102*a* may be provided with a pull out position, which exposes a hinge member 111, as illustrated by FIG. 5. The hinge member 111 of each side extension arms 102 and 102*a* is normally accommodated within the tubular member 42. However, when slidable exposed by fully extending a side extension arm, for example, 102 to the pull out position, hinge member 111 permits arm 102 to be folded 90° from its substantially horizontal extended position illustrated by arm 102*a*. In this folded position, side extension arm 102*a* may be rotated thereabout as illustrated.

In the stowed position, the side extension arms 102 and 102*a* provide a small profile in order to be unobtrusive to attendants working around the cot frame 9. In the extended position, the side extension arms 102 and 102*a* provide a convenient handling surface for attendants to situate themselves around the cot frame 9 in order to control the movement and lifting of the undercarriage into an emergency vehicle. It is to be appreciated that these side extension arms 102 and 102*a* provide the cot frame 9 with added handling points by which extra attendants may help to lift a large body person situated on the cot frame to and from the emergency vehicle.

Figure 6:
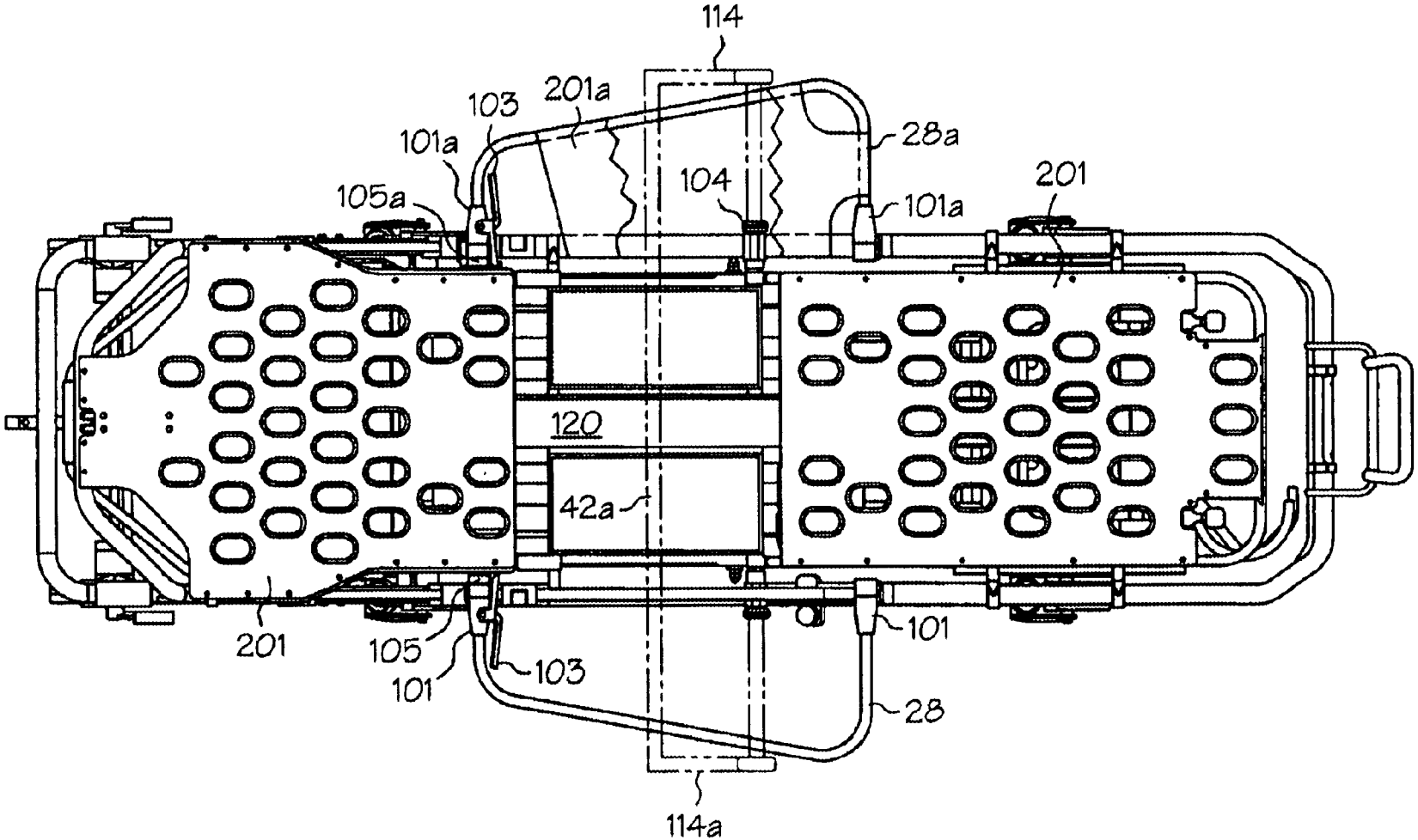
FIG. 6 is a top view of another cot structure embodiment of the invention, with parts in dotted lines for purposes of illustration.

Referring back to FIG. 1*b,* it is to be appreciated that each of the folding side arms 28 and 28*a* is rotatably connected to the cot frame 9 by a respective pair of side arm mounts 101 and 101*a*. The side arm mounts 101 and 101*a* are mounted to their respective longitudinal side frame member 10 or 11. The side arms 28 and 28*a* each rotates about their respective longitudinal side frame members 10 and 11, thereby providing 180° rotational freedom from a vertically-up position, as illustrated, to a vertically-down position illustrated by the dotted lines in FIG. 1*b*. A side-arm release 103 is provided to each of the side arm mounts 101 and 101*a*. With reference to FIG. 6, when a technician pulls the side-arm release, spring biased holding pins (not shown) are lifted from a set of recess in the latch block 105 and 105*a* mounted at the end portion of the respective folding side arm that is rotatably mounted to the side frame member. It is to be appreciated that with the set of recesses, the folding side arms may be releasably positioned substantially horizontal to the cot frame 9 or approximately 90° from vertical.

Each folding side arm 28 and 28*a* may be positioned above or below their respective side extension arm 102 and 102*a*. Situating the folding side arms 28 and 28*a* below their respective side extension arms, as illustrated by 102, the folding side arms are structural reinforced by the side extension arms such that two or more attendants may use the folding side arms as a lifting surface. Such a lifting configuration is useful in situations when handling a person of an extreme amount of weight (i.e., greater than 300 lbs). Situating the folding side arms 28 and 28*a* above their respective side extension arms, as illustrated by 102*a* by dotted line, the folding side arms are provided with structural support. Such a supporting configuration is useful to increase the support surface area of the cot support surface to accommodate person requiring additional cot space (i.e., obesity). Further, the supporting configuration is useful if necessary to hang emergency equipment/medical devices, and/or personal belongs of the victim.

Referring to FIG. 6, illustrating other embodiments of the invention, if desires, one or both side arm supports 28 and 28*a* may be provided with an additional support surface covering 201*a*. Moreover, the end cap portion 104 of each side extension arm 102 and 102*a* may be shaped in a number of various configurations, which are illustrated in FIG. 2*a* as for example and not to be limited by, dotted lines 106, 108, 110, and 112. As shown, provided is a plug-end or doughnut-shaped portion 104, a T-shaped end portion 106, a mushroom shaped end portion 108, an angled-bracket end portion 110, and a U-shaped or umbrella handle end portion 112, each of the various end cap portion configurations providing their own unique advantages.

As illustrated by FIG. 6, a pair of double-sided extension arms may be provided to the cot frame 9, which are illustrated by dotted lines 114 and 114*a*. In this configuration, an additional transverse hollow tubular member 42*a* is included in the cot construction, wherein the pair of transverse members 42 and 42*a* slidably house within their interior cavity the arm portions 116 of each double-sided extension arm 114 and 114*a*. As also illustrated, the arm portions 116 of each double-sided extension arms extend substantially perpendicular to its respective side frame members 3 and 4. In the stowed position, a handle portion 118 being the portion which spans between the arm portions 116 of the double side extension 114, is situated adjacent its respective side frame member 3 or 4, substantial flush, thereby providing a unobtrusive profile.

Further, to provide the above described cot construction embodiments with an increased load bearing capacity, a central strength member 120 is provided to the cot frame 9. Preferably, the central strength member 120 is an I-beam construction. The transverse members of the cot frame 9 such as, for example, frame member 13, transverse members 42 and 42*a,* and additional traverse frame members 122, 124, and 126 are mounted (e.g., bolted, welded, etc.) to the central strength member 120. It is to be appreciated that centrally supporting and/or connecting these transverse members to the strength member 120 permits increased load bearing of the cot 100 by distributing more evenly the weight throughout the cot frame 9. Accordingly, the cot 100 of the present invention is capable of supporting loads upon the cot frame up to about 600 lbs.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is therefore, claimed in any of its forms or modifications within the proper scope of the appended claims appropriately interpreted in accordance with the doctrine of equivalents. Any modification of the present invention which comes within the spirit and scope of the following claims should be considered part of the present invention.

What is claimed is:

1. An elevating cot adapted to be rolled into emergency vehicles, said cot comprising:

a generally rectangular cot frame having a leading end and a trailing end; and a pair of side extension arms provided to said cot frame between said leading end and said trailing end, each of said side extension arms being adapted to slidably extend a handling surface outwardly from a stowed position adjacent said cot frame to an extended position substantially perpendicular to said cot frame, said handling surface being useable to control the movement and lifting of the cot.

2. The cot structure claimed in claim 1, wherein each of said side extension arms includes an end portion having a shaped selected from the group consisting of doughnut shaped, T-shaped, U-shaped, mushroom-shaped, angled-bracket shaped, and combinations thereof.

3. The cot structure claimed in claim 1, wherein each of said side extension arms includes a handle portion spanning between a pair of arm portions which slidably extend perpendicular to said cot frame.

4. The cot structure claimed in claim 1, wherein said cot frame includes an opposing pair of tubular side frame members and a tubular traverse frame member spanning between said side frame members, wherein said traverse frame member slidably accommodating said side extension arms.

5. The cot structure claimed in claim 4 wherein each said side frame member rotatably mounts a folding side arm, said folding side arm adapted to be positioned above or below a respective one of said side extension arms.

6. The cot construction claimed in claim 1 wherein said cot frame is adapted to receive a removable top adapted to be seated on said cot frame, said cot frame having forward and rearward pairs of seats positioned to receive said removable top.

7. An elevating cot adapted to be rolled into emergency vehicles, said cot comprising:

a generally rectangular undercarriage having wheels;

a generally rectangular cot frame having a leading end and a trailing end;

leg members interconnecting said cot frame and said undercarriage;

a latching device adapted to selectively secure said leg members in a plurality of elevational positions; and a pair of side extension arms provided to said cot frame between said leading end and said trailing end, each of said side extension arms being adapted to slidably extend a handling surface outwardly from a stowed position adjacent said cot frame to an extended position substantially perpendicular to said cot frame, said handling surface being useable to control the movement and lifting of the cot.

8. The cot structure claimed in claim 7, wherein each of said side extension arms includes an end portion having a shaped selected from the group consisting of doughnut shaped, T-shaped, U-shaped, mushroom-shaped, angled-bracket shaped, and combinations thereof.

9. The cot structure claimed in claim 7, wherein each of said side extension arms includes a handle portion spanning between a pair of arm portions which slidably extend perpendicular to said cot frame.

10. The cot structure claimed in claim 7, wherein said cot fame includes an opposing pair of tubular side frame members and a tubular traverse frame member spanning between said side frame members, wherein said traverse frame member slidably accommodating said side extension arms.

11. The cot structure claimed in claim 10 wherein each said side frame member rotatably mounts a folding side arm, said folding side arm adapted to be positioned above or below a respective one of said side extension arms.

12. The cot construction claimed in claim 7 wherein said cot frame is adapted to receive a removable top adapted to be seated on said cot frame, said cot frame having forward and rearward pairs of seats positioned to receive said removable top.

13. An elevating cot adapted to be rolled into emergency vehicles, said cot comprising:

a generally rectangular undercarriage having a leading end and a trailing end, wheels affixed to said undercarriage;

a generally rectangular cot frame overlying said undercarriage, said cot frame having a leading end and a trailing end;

co-acting pairs of complementary cross-forming frame members extending between and interconnecting said cot frame and said undercarriage, each of said pairs of frame members comprising a first frame member of fixed length and a second frame member having an extensible section at its lowermost end, a latching device adapted to selectively secure said cross-forming members in a plurality of elevational positions; and a pair of side extension arms provided to said cot frame between said leading end and said trailing end, each of said side extension arms being adapted to slidably extend a handling surface outwardly from a stowed position adjacent said cot frame to an extended position substantially perpendicular to said cot frame, said handling surface being useable to control the movement and lifting of the cot.

14. The cot structure claimed in claim 13, wherein each of said side extension arms includes an end portion having a shaped selected from the group consisting of doughnut shaped, T-shaped, U-shaped, mushroom-shaped, angled-bracket shaped, and combinations thereof.

15. The cot construction claimed in claim 13 wherein said cot frame is adapted to receive a removable top adapted to be seated on said cot frame, said cot frame having forward and rearward pairs of seats positioned to receive said removable top.

16. The cot construction claimed in claim 13, wherein each of said pair of side extension arms is attached to a hinge member, and further has a pull-out position, each said pair of side extension arms in said pull-out position is adapted to be located in a folded position.

17. The cot structure claimed in claim 13, wherein said cot frame includes an opposing pair of tubular side frame members and a first tubular traverse frame member spanning between said side frame members, wherein said first traverse frame member slidably accommodating said side extension arms.

18. The cot structure claimed in claim 17, wherein said cot frame includes a second tubular traverse frame member spanning between said side frame members, wherein each of said side extension arms includes a handle portion spanning between first and second arm portions which are slidably accommodated respectively in said first and second traverse frame members.

19. The cot structure claimed in claim 18 wherein each said side frame member rotatably mounts a folding side arm, said folding side arm adapted to be positioned above or below a respective one of said side extension arms.

20. The cot structure claimed in claim 17 wherein said cot frame includes a beam member traversing and interconnecting said traverse frame member and additional traverse frame members spanning between said opposing pair of tubular side frame members of said cot frame.

21. An elevating cot adapted to be rolled into emergency vehicles, said cot comprising:

a generally rectangular cot frame having a leading end and a trailing end; and a pair of side extension arms provided to said cot frame between said leading end and said trailing end, each of said side extension arms being adapted to slidably extend outwardly from a stowed position adjacent said cot frame to an extended position substantially perpendicular to said cot frame, and each of said side extension arms being releasably securable in at least said extended position.

* * * * *